US007899354B2

(12) United States Patent
Handa et al.

(10) Patent No.: US 7,899,354 B2
(45) Date of Patent: Mar. 1, 2011

(54) CLEANING DEVICE, PROCESS CARTRIDGE AND IMAGE FORMATION APPARATUS

(75) Inventors: Osamu Handa, Kanagawa (JP); Masahiro Katahira, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1000 days.

(21) Appl. No.: 11/730,474

(22) Filed: Apr. 2, 2007

(65) Prior Publication Data

US 2008/0075499 A1 Mar. 27, 2008

(30) Foreign Application Priority Data

Sep. 27, 2006 (JP) ..... 2006-263409

(51) Int. Cl.
*G03G 15/02* (2006.01)

(52) U.S. Cl. ..... 399/100; 15/256.51

(58) Field of Classification Search ..... 399/100; 101/425, 423; 15/256.51
See application file for complete search history.

(56) References Cited

U.S. PATENT DOCUMENTS 5,046,422 A * 9/1991 Shinmoto ..... 101/425
5,322,015 A * 6/1994 Gasparrini ..... 101/425
5,740,494 A * 4/1998 Shoji et al. ..... 399/71
5,870,954 A * 2/1999 Lovenstein et al. ..... 101/423
5,943,956 A * 8/1999 Marquez et al. ..... 101/425
6,684,784 B2 * 2/2004 Kolbe et al. ..... 101/425
7,062,194 B2 * 6/2006 Yanagida et al. ..... 399/100
2005/0022729 A1 * 2/2005 Kiiski et al. ..... 118/203
2006/0165431 A1 * 7/2006 Yanagida et al. ..... 399/100
2007/0122180 A1 * 5/2007 Miyaji ..... 399/100
2008/0236423 A1 * 10/2008 Baumann et al. ..... 101/425

FOREIGN PATENT DOCUMENTS

JP 8-22173 1/1996
JP 8-62949 3/1996

* cited by examiner

*Primary Examiner*—David M Gray
*Assistant Examiner*—G. M. Hyder
(74) *Attorney, Agent, or Firm*—Morgan, Lewis & Bockius LLP

(57) ABSTRACT

The present invention provides a cleaning device including a cleaning member that cleans a surface of a rotating cylindrical element to be cleaned, and whose length in a longitudinal direction is longer than a length of the maximum operating region of the element to be cleaned, a length of a contact part of the cleaning member at which the cleaning member contacts with the element to be cleaned being shorter than the length in the longitudinal direction of the cleaning member, and the contact part being moved in the longitudinal direction of the element to be cleaned.

15 Claims, 18 Drawing Sheets

CLEANING DEVICE, PROCESS CARTRIDGE AND IMAGE FORMATION APPARATUS

CROSS-REFERENCE TO RELATED APPLICATIONS

This application is based on and claims priority under 35 USC 119 from Japanese Patent Application No. 2006-263409 filed Sep. 27, 2006.

BACKGROUND

1. Technical Field

The present invention relates to a cleaning device, a process cartridge and an image formation apparatus.

2. Related Art

In recent years, the contact charging method, which causes an electrically conductive charging roll or the like, to be directly contacted with a photosensitive material for charging the photosensitive material has become a leading method, because the amount of ozone and nitrogen oxides generated is smaller to a large extent, and the power efficiency is good.

With such a contact charging method, the charging roll is press-contacted with the surface of a photosensitive material with a pressure more than or equal to a predetermined value, thus foreign matters, such as toner, paper dust or the like, left on the photosensitive material are adhered to the charging roll, which may cause poor charging. Thus, a cleaning member which is contacted with the overall length in the longitudinal direction of the surface of the charging roll is provided, however, deflection of the cleaning member and the like make it difficult to cause the cleaning member to be contacted uniformly in the longitudinal direction of the charging roll.

SUMMARY

A cleaning device of an aspect of the present invention includes a cleaning member that cleans a surface of a rotating cylindrical element to be cleaned, and whose length in a longitudinal direction is longer than a length of the maximum operating region of the element to be cleaned, a length of a contact part of the cleaning member at which the cleaning member contacts with the element to be cleaned being shorter than the length in the longitudinal direction of the cleaning member, and the contact part being moved in the longitudinal direction of the element to be cleaned.

BRIEF DESCRIPTION OF THE DRAWINGS

Exemplary embodiments of the invention will be described in detail with reference to the following figures, wherein:

FIG. 9B a side view of the modified contact part moving device; and FIG. 9C a front view of the modified contact part moving device;

DETAILED DESCRIPTION

Hereinbelow, exemplary embodiments of an image formation apparatus pertaining to the present invention will be described with reference to the drawings.

Figure 1:
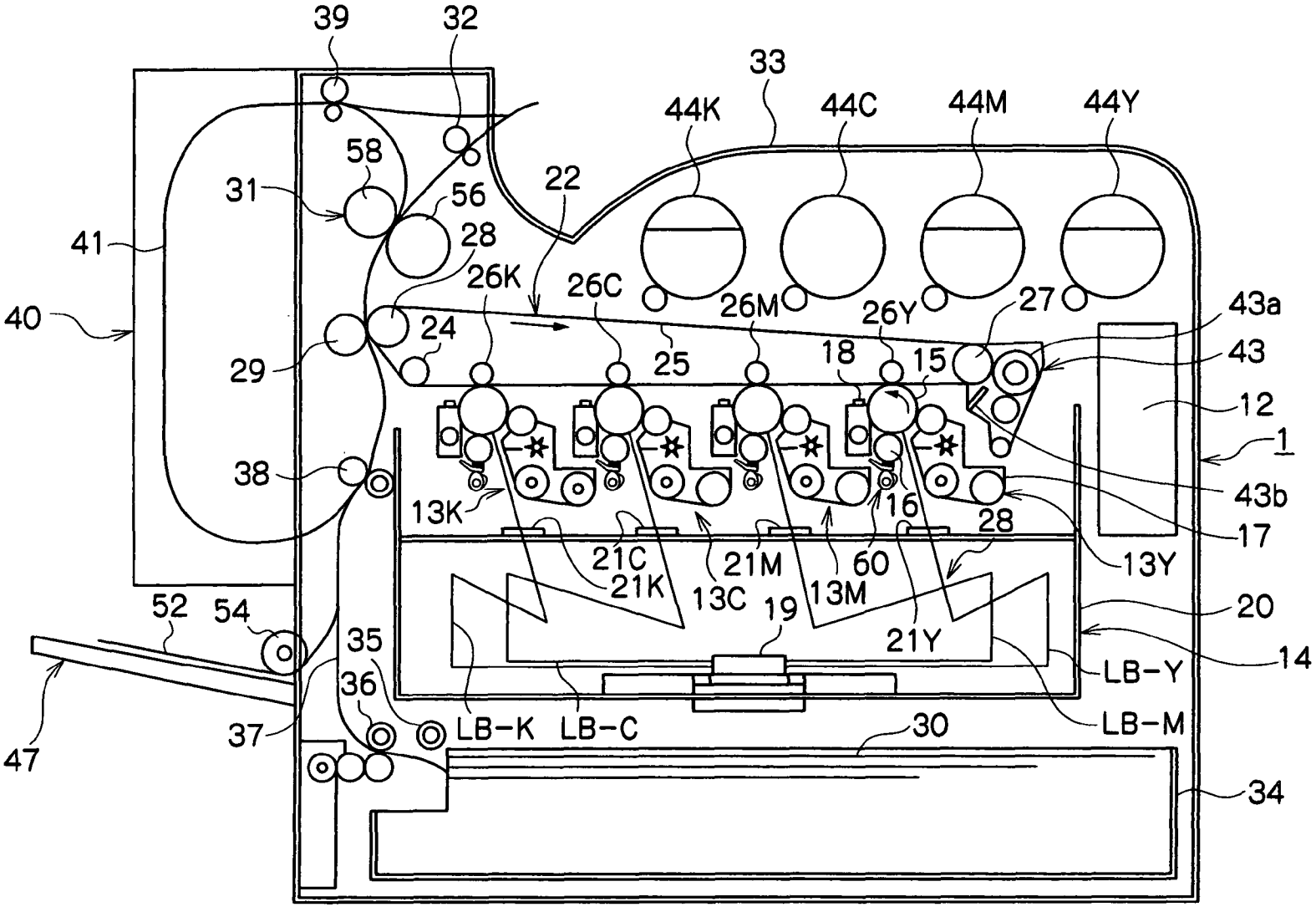
FIG. 1 is a schematic configuration drawing illustrating an image formation apparatus pertaining to a first exemplary embodiment of the present invention.

FIG. 1 shows an image formation apparatus 1 of a first exemplary embodiment of the present invention.

This image formation apparatus 1 is a digital color printer, and image data which is sent from a reading device for an original document (illustration thereof is omitted), a personal computer, or the like, is sent to an image processing device 12 to be subjected to a prescribed image process. The image data which has been subjected to the prescribed image process by the image processing device 12 is converted into tone data of coloring materials for reproducing original documents, i.e., tone data of yellow (Y), magenta (M), cyan (C), and black (K), (each eight bits) by the same image processing device 12, which, as described later, is sent to an exposure device 14 for image formation units 13Y, 13M, 13C, and 13K for respective colors of yellow (Y), magenta (M), cyan (C), and black (K).

With this exposure device 14, image exposure by a laser beam LB is performed according to the tone data of coloring materials for reproducing documents.

In the inside of the image formation apparatus 1, the four image formation units 13Y, 13M, 13C, and 13K for yellow (Y), magenta (M), cyan (C), and black (K) are disposed in parallel manner in the horizontal direction with a predetermined space therebetween. These four image formation units 13Y, 13M, 13C, and 13K are all configured in the same manner, each of the image formation units is configured to include a photosensitive drum 15 which is rotationally driven; a charging roll 16 which uniformly charges a surface of this photosensitive drum 15; an exposure device 14 which exposes an image-light corresponding to a predetermined color on the surface of the photosensitive drum 15 for forming an electrostatic latent image; a developer unit 17 which develops the electrostatic latent image formed on the photosensitive drum 15 with toner of the predetermined color; and a cleaning device 18 which cleans the surface of the photosensitive drum 15.

The exposure device 14 is configured commonly to the four image formation units 13Y, 13M, 13C, and 13K, and is configured such that, according to the tone data of respective coloring materials for reproducing original documents, four semiconductor lasers (not shown) are modulated to cause laser beams LB-Y, LB-M, LB-C, and LB-K to be emitted from these semiconductor lasers according to the tone data. The exposure device 14 may, of course, be individually configured for each of the plural image formation units. The laser beams LB-Y, LB-M, LB-C, and LB-K emitted from the above-mentioned semiconductor lasers are irradiated onto a polygon mirror (a multiple-face mirror) 19 through a f-θ lens (not shown), and deflect-scanned by this polygonal mirror 19. The laser beams LB-Y, LB-M, LB-C, and LB-K deflect-scanned by the polygonal mirror 19 are scan-exposed onto the exposure position on the photosensitive drum 15 from slantwise lower side through an imaging lens and plural mirrors (not shown).

The exposure device 14 scan-exposes an image-light onto the photosensitive drum 15 from lower side, thus there is a possibility that, onto this exposure device 14, the toner or the like may be dropped from the developer units 17 or the like of the four image formation units 13Y, 13M, 13C, and 13K which are located above, resulting in the exposure device 14 being contaminated. Therefore, the exposure device 14 is sealed at the surroundings thereof by a frame 20 in the shape of a rectangular parallelepiped, and on the top of the frame 20, window parts 21Y, 21M, 21C, and 21K as shield members that are made of a transparent glass are provided in order to expose the four laser beams LB-Y, LB-M, LB-C, and LB-K onto the photosensitive drums 15 in the respective image formation units 13Y, 13M, 13C, and 13K.

From the image processing device 12, image data of the respective colors of yellow (Y), magenta (M), cyan (C), and black (K) is sequentially outputted to the exposure device 14, which is commonly provided for the image formation units 13Y, 13M, 13C, and 13K for the respective colors. The laser beams LB-Y, LB-M, LB-C, and LB-K emitted from the exposure device 14 according to the image data are scan-exposed onto the surface of the corresponding photosensitive drums 15 for formation of electrostatic latent images. The electrostatic latent images formed on the photosensitive drums 15 are developed by the developer units 17Y, 17M, 17C, and 17K as toner images of the respective colors of yellow (Y), magenta (M), cyan (C), and black (K), respectively.

The toner images of the respective colors of yellow (Y), magenta (M), cyan (C), and black (K) that have been sequentially formed on the photosensitive drums 15 in the respective image formation units 13Y, 13M, 13C, and 13K are multiply transferred, by four primary transfer rolls 26Y, 26M, 26C, and 26K, onto an intermediate transfer belt 25 in the transfer unit 22 that is disposed above across the respective image formation units 13Y, 13M, 13C, and 13K. These primary transfer rolls 26Y, 26M, 26C, and 26K are disposed on the side of the rear face of the intermediate transfer belt 25, corresponding to the photosensitive drums 15 of the respective image formation units 13Y, 13M, 13C, and 13K. To the primary transfer rolls 26Y, 26M, 26C, and 26K, a transfer bias power supply (not shown) is connected, and a transfer bias having a polarity opposite to a predetermined toner polarity (a positive polarity in the present exemplary embodiment) is applied at a predetermined timing.

The intermediate transfer belt 25 is wound around a drive roll 27 for driving the intermediate transfer belt 25, a tension roll 24 for providing a tension for the intermediate transfer belt 25, and a backup roll 28 for supporting the intermediate transfer belt from back side 25 in the secondary transfer section, with a constant tension, and is driven for circulation in a clockwise direction in the figure at a predetermined speed by the drive roll 27 which is rotationally driven by a motor (not shown).

The toner images of the respective colors of yellow (Y), magenta (M), cyan (C), black (K) that have been multiply transferred onto the intermediate transfer belt 25 are secondarily transferred onto a recording paper 30 as a sheet by a secondarily transfer roll 29 which is pressure contacted with the backup roll 28, and the recording paper 30 to which the toner images of these respective colors have been transferred is conveyed to a fuser 31 which is located above. The secondarily transfer roll 29 is pressure contacted with the backup roll 28 at the side, and secondarily transfers the toner images of the respective colors onto the recording paper 30 conveyed upward from the lower side. The fuser 31 includes a heat roll 56 which is heated to a predetermined temperature, and a pressure roll 58 which is pressure contacted with this heat roll 56. The recording paper 30 onto which the toner images of the respective colors have been transferred is subjected to a fixing process with heat and pressure in the pressure contact portion of the heat roll 56 and the pressure roll 58, thereafter, the recording paper 30 is output onto an exit tray 33 provided on the top of the image formation apparatus 1 by an exit roll 32.

The recording paper 30 of a predetermined size is once conveyed from a feed cassette 34 to a registration roll 38 for determining the position of the paper in the axial direction through a paper convey path 37 by a pickup roller 35 and a paper separation feeding roller pair 36, and stopped. The paper convey path 37 for the fed recording paper 30 is directed upward in the vertical direction. The recording paper 30 supplied from the feed cassette 34 is fed out to the secondary transfer position of the intermediate transfer belt 25 by the registration roll 38 rotated at a predetermined timing.

In the image formation apparatus 1, in a case of a double-sided copy of full color or the like, a recording paper 30 on one side of which an image is fixed is not output onto the exit tray 33 by the exit roll 32 as it is, but the convey direction of the recording paper 30 is switched by a switching gate (not shown) such that the recording paper 30 is conveyed to a convey unit for double-sided copy 40 through a paper convey roller pair 39. In this convey unit for double-sided copy 40, the recording paper 30 in a state of being inverted to be backside-up is conveyed by a convey roller pair (not shown) provided along a convey path 41 again to the registration roll 38. Then, after an image being transferred and fixed on the back side of the recording paper 30, the recording paper 30 is output onto the exit tray 33.

In addition, the surface of the photosensitive drum 15 after the process of transferring the toner image having been completed is cleaned of the residual toner, the paper dust and the like by a cleaning device 18 to prepare for the subsequent image formation process. The cleaning device 18 is provided with a cleaning blade (not shown), and with this cleaning blade, the residual toner, the paper dust and the like on the photosensitive drum 15 are removed.

In addition, the surface of the intermediate transfer belt 25 after the process of transferring the toner image having been completed is cleaned of the residual toner, the paper dust and the like by a cleaning device 43 to prepare for the subsequent image formation process. The cleaning device 43 includes a cleaning brush 43*a* and a cleaning blade 43*b*, and with these cleaning brush 43*a* and cleaning blade 43*b*, the residual toner, the paper dust and the like on the intermediate transfer belt 25 are removed.

In the upper part of the inside of the image formation apparatus 1, toner cartridges 44Y, 44M, 44C, and 44K which accommodate toner of yellow, magenta, cyan, and black are provided, respectively, for supplying the toners of predetermined colors to the developer units 17 of the respective colors.

In addition, at the side face (the left side face in FIG. 1) of the image formation apparatus 1, a manual feed tray 47 on which an optional sheet can be loaded is attached. On this manual feed tray 47, a recording paper 52 as a sheet is put, and the recording paper 52 is fed by a feed roller 54 to be conveyed to the registration roll 38. The recording paper 52 is different in type and size from the above-mentioned recording paper 30.

Figure 2:
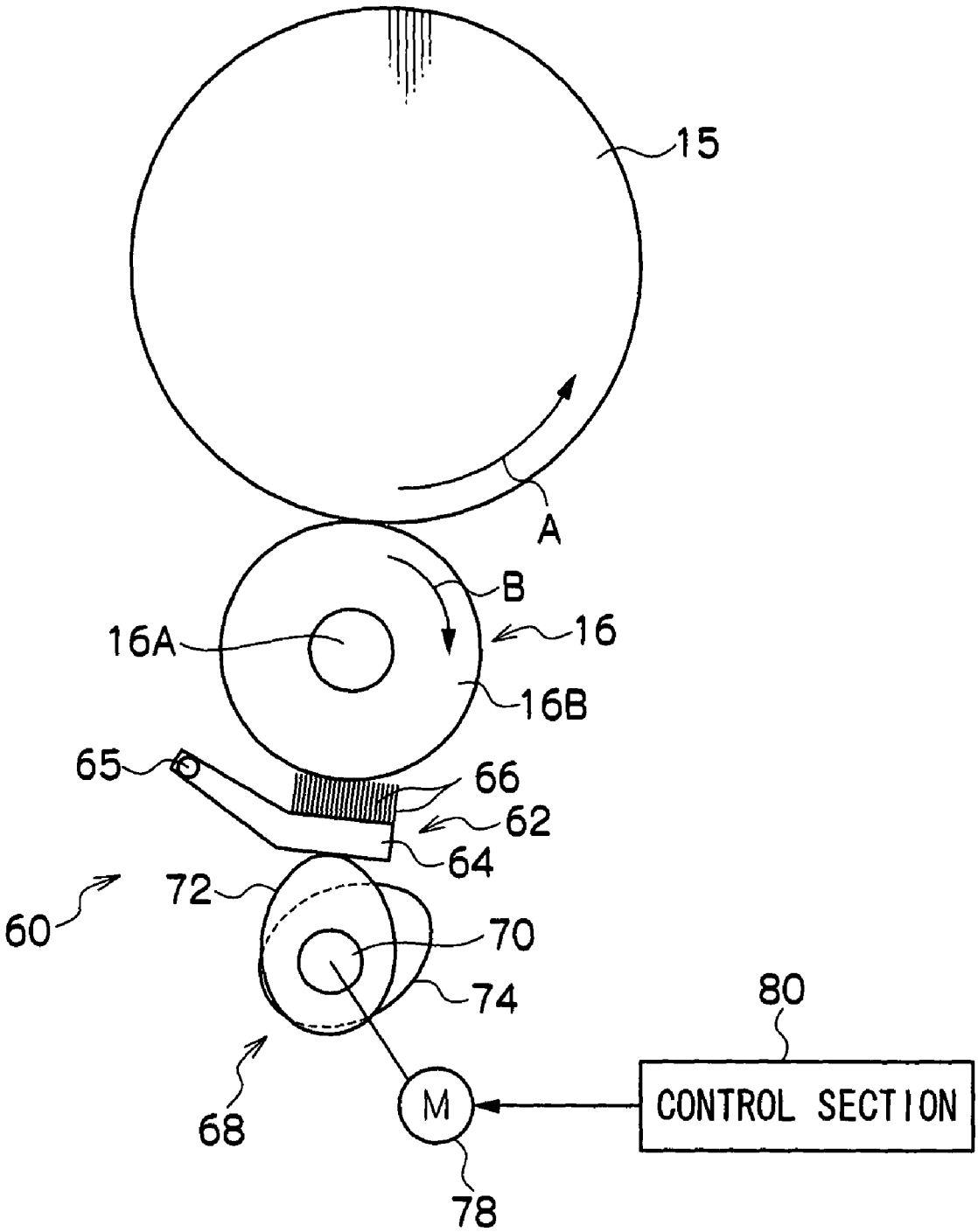
FIG. 2 is a configuration drawing illustrating a charging roll, a cleaning brush, a contact part moving device, and components in the vicinity thereof which are used in the image formation apparatus as shown in FIG. 1.

As shown in FIG. 2, the photosensitive drum 15 is rotationally driven in the direction of arrow A (a counterclockwise direction) by a motor (not shown). In addition, the charging roll 16 is configured such that it is contacted with the surface of the photosensitive drum 15 to be rotated in the direction of arrow B, by being driven by (following) the rotation of the photosensitive drum 15. In addition, under the charging roll 16 (on the side opposite to the photosensitive drum 15), a cleaning device 60 which cleans the surface of the charging roll 16 is provided.

Figure 4B:
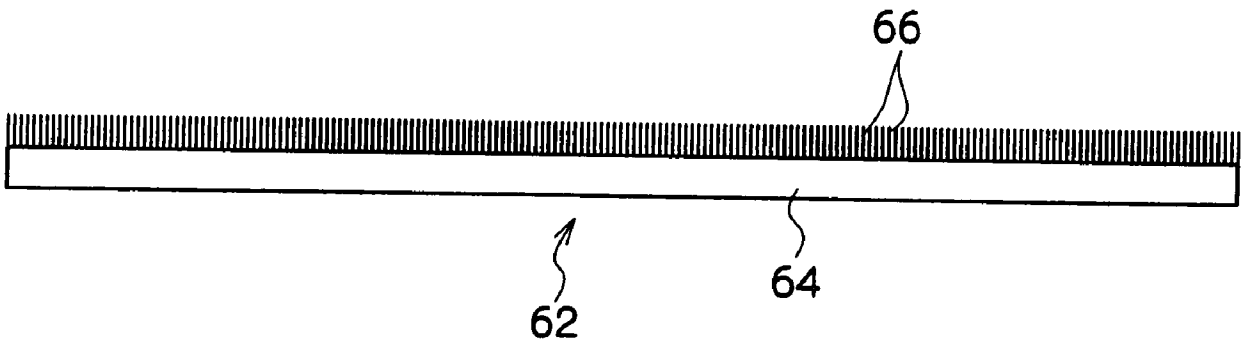
FIG. 4B is a front view of the cleaning brush.
Figure 4A:
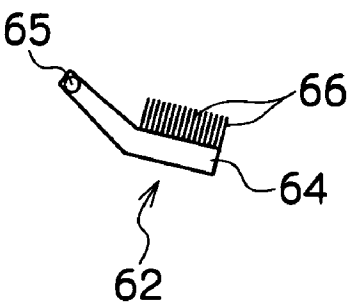
FIG. 4A is a side view of a cleaning brush.

In this cleaning device 60, a cleaning brush 62 which is contacted with the surface of the charging roll 16 for cleaning it is provided. As shown in FIGS. 4A and 4B, with the cleaning brush 62, plural brush bristles 66 are planted on one side of a support member 64 which is folded at an obtuse angle, and the support member 64 is supported so as to be able to swing by a pivotal shaft 65 provided on the other side of the support member 64. The pivotal shaft 65 is inserted into a long hole formed in a frame (not shown) in the vertical direction to be movable in the vertical direction. As shown in FIG. 4B, a portion of the support member 64 on which the brush bristles 66 are planted is formed in the shape of a flat plate having an approximately uniform thickness along the longitudinal direction of the charging roll 16.

Figure 3A:
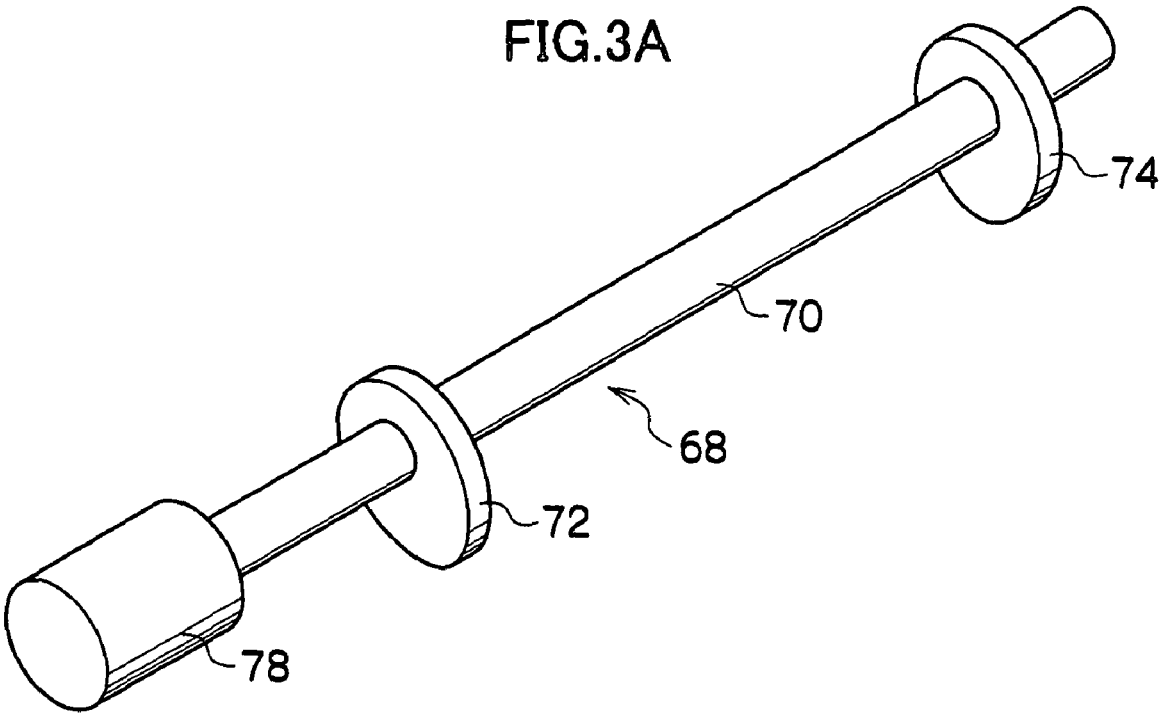
FIG. 3A is a perspective view of a contact part moving device.
Figure 3B:
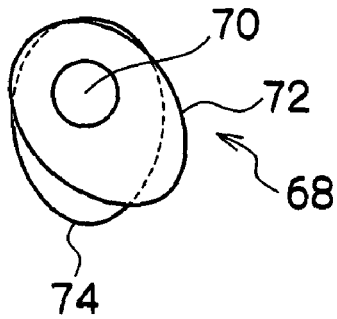
FIG. 3B is a side view of the contact part moving device.
Figure 3C:
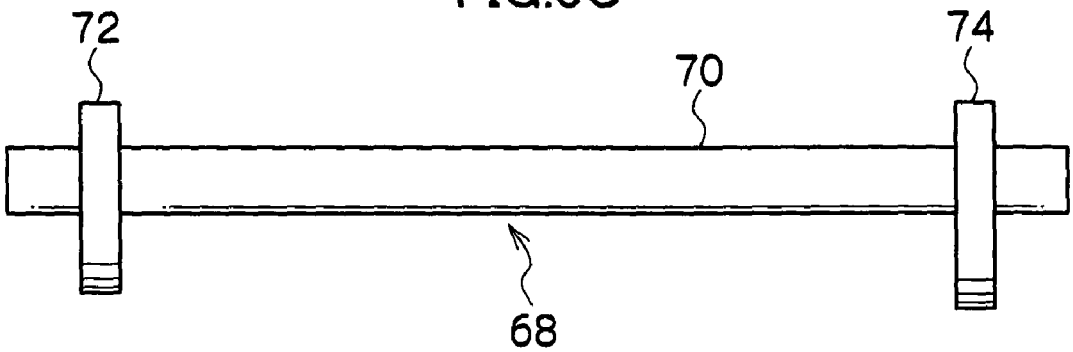
FIG. 3C is a front view of the contact part moving device.

On the back face side of the support member 64 (the side opposite to the charging roll 16), a contact part moving device 68 is provided. The contact part moving device 68 causes the cleaning brush 62 to be contacted with the charging roll 16 in a region shorter than the length in the longitudinal direction, and causes a contact part of the cleaning brush 62, at which part the cleaning brush 62 contacts with the charging roll 16, to be moved in the longitudinal direction of the charging roll 16. As shown in FIGS. 3A, 3B, and 3C, the contact part moving device 68 includes two cam members 72, 74 on both sides of a shaft 70, and in the end portion of the shaft 70, a motor 78 which causes the shaft 70 to be rotated is provided. As shown in FIG. 3B, the cam members 72, 74 are substantially in the shape of an ellipse, having the same profile, however, being attached to the shaft 70 with their phases being shifted (different) from each other. The drive of the motor 78 and the timing are controlled by a control section 80. As the motor 78, a stepping motor which is changeable in rotational speed is used. The cam members 72, 74 may be members having a circular cross section and a position of an axis of rotation (a shaft center) being shifted from a center thereof, that is, so-called, eccentric cams The contact part moving device 68 is configured such that, by the cam members 72, 74 butting against the support member 64 respectively while being rotated, the amount of pressing the cleaning brush 62 against the charging roll 16 is changed so that the cleaning brush 62 is caused to be apart from or contacted with the charging roll 16.

Next, the details of the charging roll 16 will be described.

In this charging roll 16, on an electrically conductive shaft 16A, an electrically conductive elastic layer and a surface layer are formed in that order as a charging layer 16B.

The diameter of the charging roll 16 is 7 mm to 15 mm, and more preferably, from 8 mm to 14 mm, and the thickness of the charging layer 16B is preferably from 2 mm to 4 mm. If the diameter of the charging roll 16 is more than or equal to 15 mm, the number of times of contacting with the external additive per given spot on the circumferential face are decreased and the number of times of discharging are decreased, thus although the contamination avoidability and the long-term stability in charging performance are excellent, there arises a need for consideration of the layout with the increase in diameter. If the diameter of the charging roll 16 is less than of equal to 7 mm, the image formation apparatus 1 can be advantageously made compact in size, but the number of times of contacting with the external additive per given spot on the circumferential face are increased and the number of times of discharging are increased.

Needless to say, this charging roll 16 is not limited to the following constitutions, provided that it has a prescribed charging performance.

As the material of the shaft 16A, free-cutting steel, stainless steel, or the like, is used, and according to the required characteristic, such as slidability, the material and the surface treatment method are selected as appropriate, and a material having no electrical conductivity may be subjected to a general treatment, such as plating treatment, or the like, for providing conductivity.

The above-mentioned electrically conductive elastic layer constituting the charging layer 16B of the charging roll 16 is made up of, for example, an elastic material having elasticity, such as rubber, or the like, and an electrically conductive agent for adjusting the resistance of the electrically conductive elastic layer, such as a carbon black, an ionic electrically conductive agent, or the like. Further, a material which can generally be added to rubber, such as a softener, a plasticizer, a curing agent, a vulcanizing agent, a vulcanization accelerator, an age resistor, and a filler, such as silica, calcium carbonate, or the like, may be added to the electrically conductive elastic layer as required. The electrically conductive elastic layer is formed by coating the circumferential face of the electrically conductive shaft 16A with a mixture into which a material which is generally added to rubber is added. As the electrically conductive agent for adjusting the resistance value, material of which electron or an ion served as a charge carrier electric-conducts, such as a carbon black, an ionic electrically conductive agent or the like, which is mixed into a matrix material, can be dispersed in electrically conductive elastic layer. In addition, the above-mentioned elastic material may be a foaming material.

The elastic material constituting the above-mentioned electrically conductive elastic layer is formed by, for example, dispersing an electrically conductive agent into the rubber material. Examples of the rubber material include isoprene rubber, chloroprene rubber, epichlorohydrin rubber, butyl rubber, urethane rubber, silicone rubber, fluorine rubber, styrene-butadiene rubber, butadiene rubber, nitrile rubber, ethylenepropylene rubber, epichlorohydrin-ethylene oxide copolymer rubber, epichlorohydrin-ethylene oxide-arylglycidyl ether copolymer rubber, ethylene-propylene-diene terpolymer rubber (EPDM), acrylonitrile-butadiene copolymer rubber, natural rubber, and the like, and blended rubbers of these. Among these, silicone rubber, ethylenepropylene rubber, epichlorohydrin-ethylene oxide copolymer rubber, epichlorohydrin-ethylene oxide-arylglycidyl ether copolymer rubber, acrylonitrile-butadiene copolymer rubber, and blended rubbers of these are preferably used. These rubber materials may be those foamed or nonfoamed.

As the electrically conductive agent, an electronic electrically conductive agent or an ionic electrically conductive agent is used. Examples of electronic electrically conductive agent include impalpable powder of carbon blacks, such as ketjen black, acetylene black, and the like; pyrolytic carbon, graphite; various electrically conductive metals or alloys, such as aluminum, copper, nickel, stainless steel, and the like; various electrically conductive metal oxides, such as tin oxide, indium oxide, titanium oxide, tin oxide-antimony oxide solid solution, tin oxide-indium oxide solid solution, and the like; insulating substances which surfaces have been subjected to a conductive treatment; and the like. In addition, examples of ionic electrically conductive agent include a perchlorate, a chlorate, and the like, such as tetraethyl ammonium, lauryl trimethyl ammonium, or the like; and a perchlorate, a chlorate, and the like, of an alkaline metal, an alkaline-earth metal, such as lithium, magnesium, or the like.

The above-mentioned surface layer constituting the charging layer 16B is formed to prevent contamination due to a foreign matter, such as toner, or the like, and as the material of the surface layer, any of resin, rubber, and the like, may be used, with no particular restriction being given. Examples include polyester, polyimide, copolymer nylon, silicone resin, acrylic resin, polyvinyl butylal, ethylene tetrafluoroethylene copolymer, melamine resin, fluorine rubber, epoxy resin, polycarbonate, polyvinyl alcohol, cellulose, polyvinylidene chloride, polyvinyl chloride, polyethylene, ethylene vinyl acetate copolymer, and the like. Among these, from the view point of external additive contamination prevention, polyvinylidene fluoride, 4-ethylene fluoride copolymer, polyester, polyimide, and copolymer nylon are preferably used.

In addition, by adapting the above-mentioned surface layer to contain an electrically conductive material, the resistance value therefor can be adjusted. The electrically conductive material preferably has a particle diameter of 3 μm or under. In addition, as the electrically conductive agent for adjusting the resistance value, material of which electron or an ion served as a charge carrier electric-conducts, such as a carbon black, electrically conductive metallic oxide particle, an ionic electrically conductive agent or the like, which is mixed into a matrix material, can be dispersed in electrically conductive elastic layer.

In addition, for the above-mentioned surface layer, a fluorine-based or silicone-based resin can be used, and particularly it is preferable to be constituted by a fluorine-modified acrylate polymer. In addition, into the surface layer, fine particles may be added. Thereby, the surface layer is rendered hydrophobic, which acts so as to prevent foreign matters from being deposited onto the charging roll 16. In addition, by adding nonconductive particles, such as alumina and silica ones, irregularities can be provided at the surface of the charging roll 16 in order to minimize the load in sliding on/abrasion with the photosensitive drum 15 for obtaining an improvement in mutual abrasion resistance between the charging roll 16 and the photosensitive drum 15.

Next, the cleaning brush 62 will be described.

As the material of the support member 64 for the cleaning brush 62, stainless steel, resin, or the like, is used. In addition, as the material of the brush bristles 66, a resin, such as nylon, or the like, is used.

Next, the operation of the image formation apparatus 1 as configured above will be described.

When the cleaning operation is started, as shown in FIG. 2, the photosensitive drum 15 is rotated in the direction of arrow A, and the charging roll 16 which is contacted with the photosensitive drum 15 is rotated in the direction of arrow B, by being driven by (following) the rotation of the photosensitive drum 15. In addition, the control section 80 drives the motor 78 to rotate the shaft 70 for rotating the cam members 72, 74.

Figure 5A:
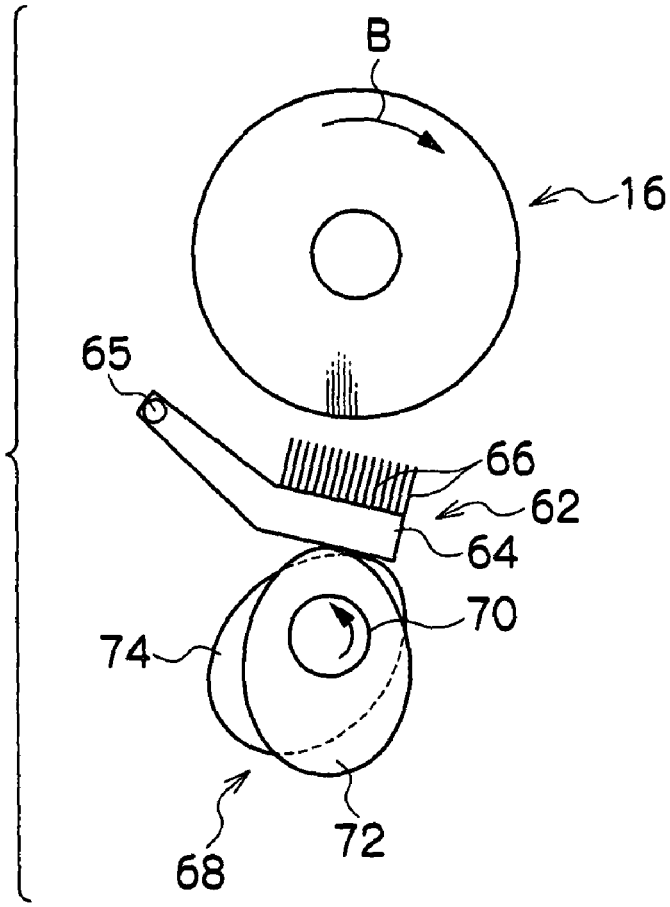
FIGS. 5A and 5B are a side view and a front view, respectively, illustrating a phase of operation of the cleaning brush and the contact part moving device.
Figure 5B:
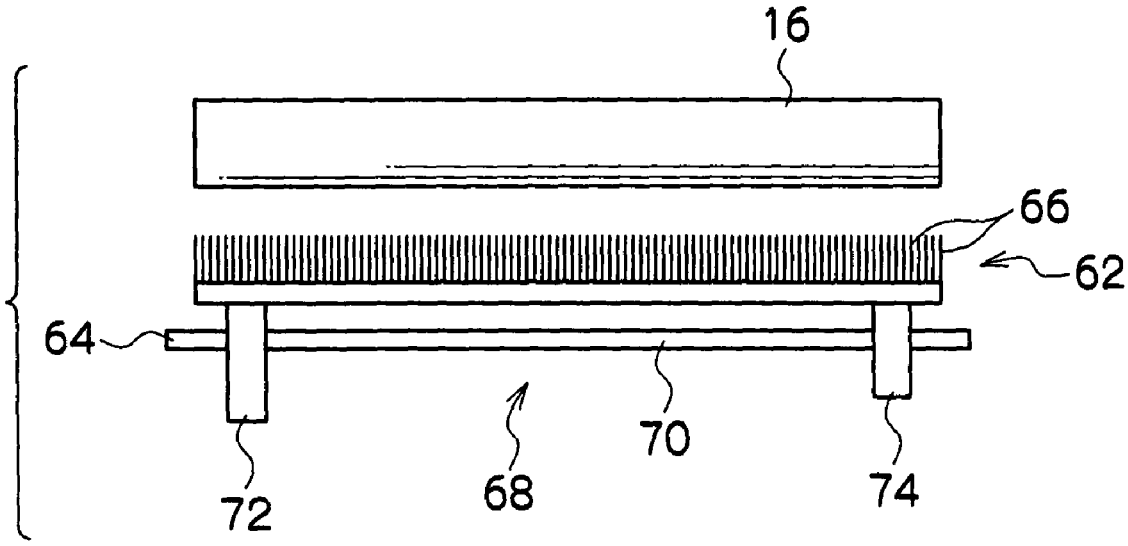
Figure 6A:
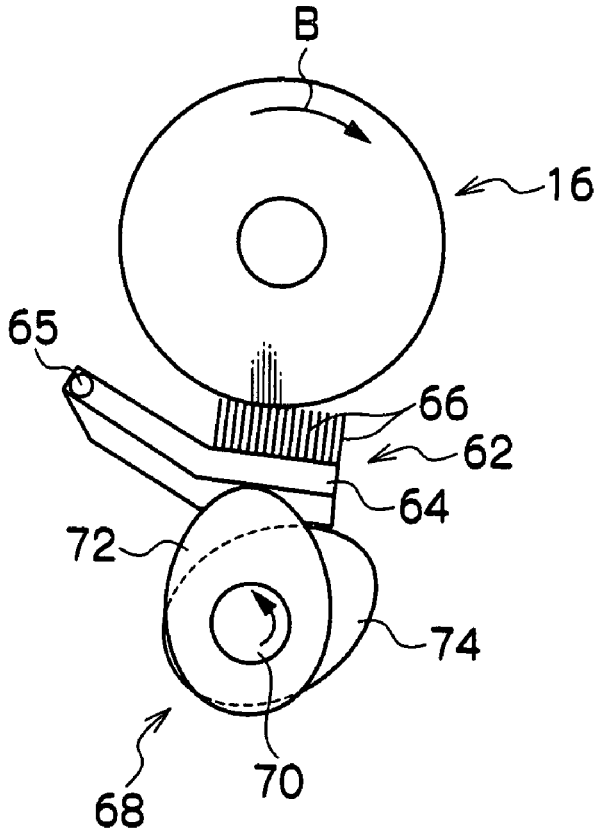
FIGS. 6A and 6B are a side view and a front view, respectively, illustrating a phase of operation of the cleaning brush and the contact part moving device.
Figure 6B:
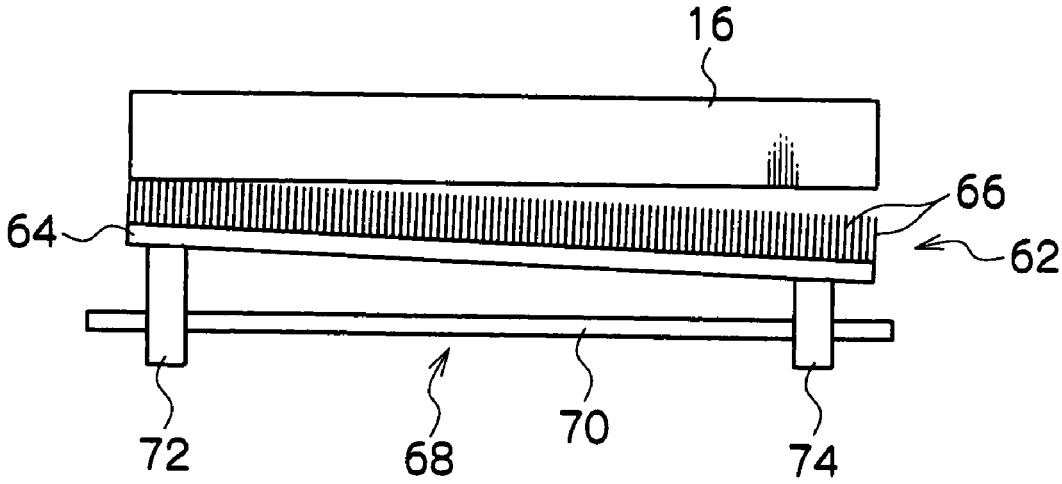

As shown in FIGS. 5A and 5B, by rotating the cam members 72, 74 to the separating position, the cleaning brush 62 and the charging roll 16 are separated from each other. When the shaft 70 is rotated in a counterclockwise direction (the direction of the arrow) from this separating position, as shown in FIGS. 6A and 6B, first, the cam member 72 which is on this side in FIG. 6A causes this side of the cleaning brush 62 to be contacted with the charging roll 16 to clean the charging roll 16. At this time, the other side of the cleaning brush 62 is separated from the charging roll 16 (brought into the state as shown in FIG. 6B). In other words, the cleaning brush 62 is contacted with the charging roll 16 in the region shorter than the length in the longitudinal direction. Here, "this side" corresponds to the left side and the other side corresponds to the right side in FIGS. 6B, 7B and 8B and the like.

Figure 7A:
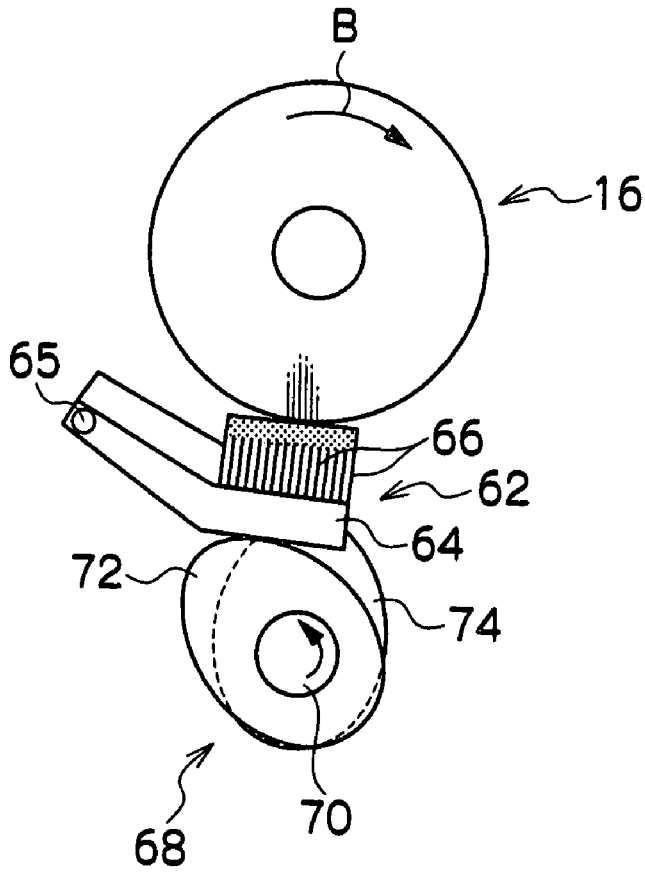
FIGS. 7A and 7B are a side view and a front view, respectively, illustrating a phase of operation of the cleaning brush and the contact part moving device.
Figure 7B:
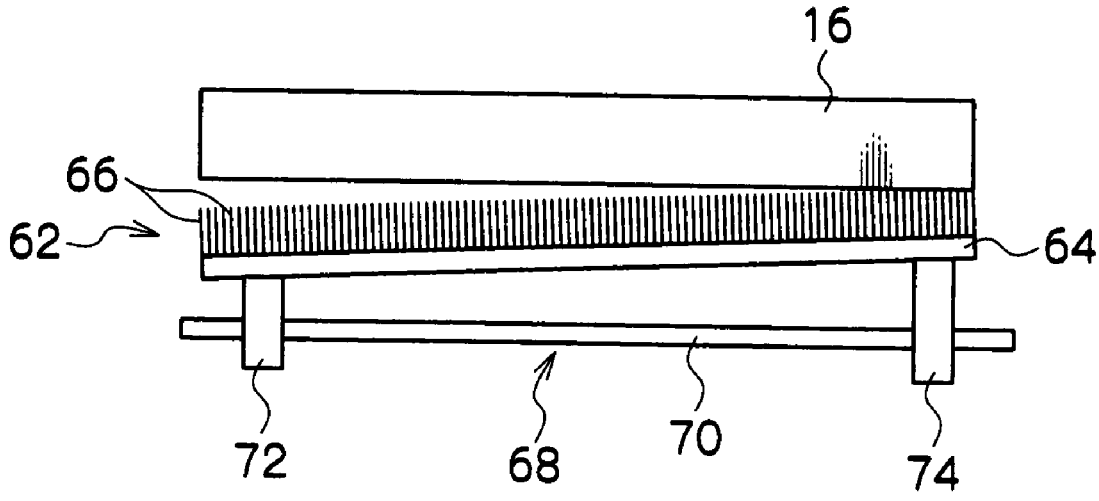

Then, as the shaft 70 is further rotated in a counterclockwise direction (the direction of the arrow), the contact part of the cleaning brush 62 with the charging roll 16 is moved from the this side to the other side, and soon, as shown in FIGS. 7A and 7B, this side of the cleaning brush 62 in FIG. 7A is separated from the charging roll 16, and the cam member 74 on the other side causes the other side of the cleaning brush 62 to be contacted with the charging roll 16 (brought into the state as shown in FIG. 7B). Thus, the contact part between the cleaning brush 62 and the charging roll 16 is moved from this side to the other side, thereby cleaning is carried out over the entire surface of the charging roll 16 in the axial direction.

Figure 8A:
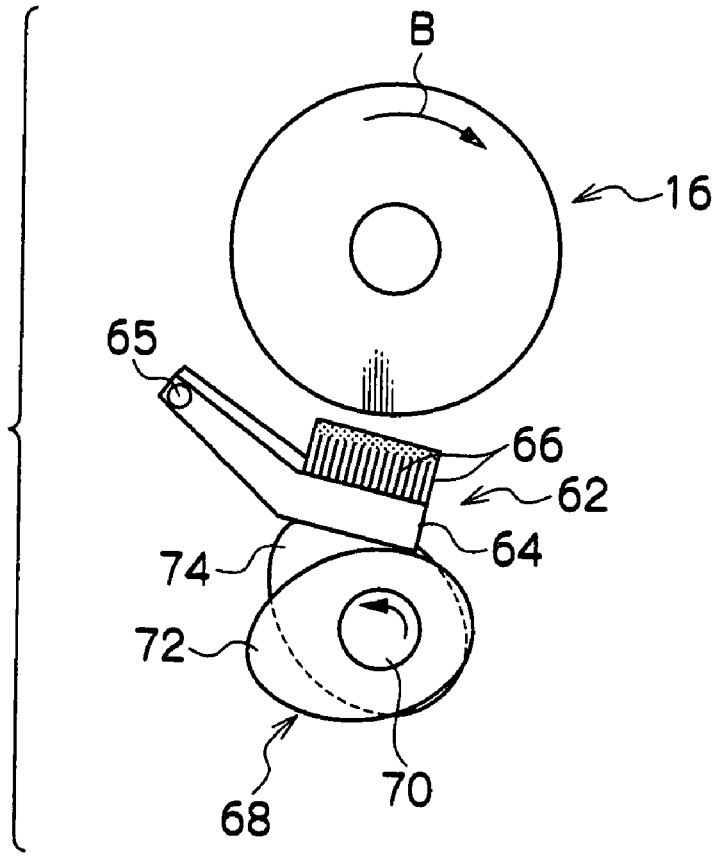
FIGS. 8A and 8B are a side view and a front view, respectively, illustrating a phase of operation of the cleaning brush and the contact part moving device.
Figure 8B:
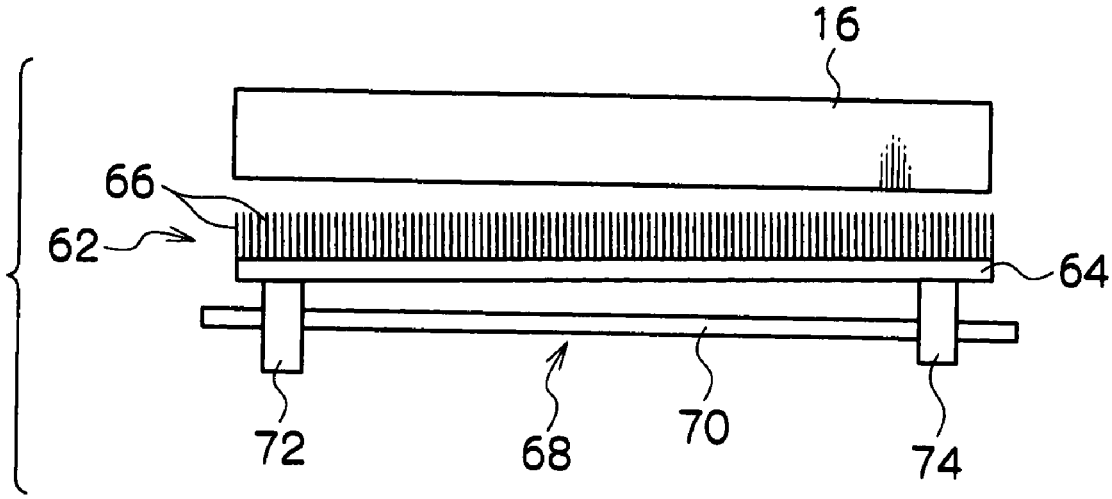

Thereafter, the shaft 70 is further rotated in a counterclockwise direction (the direction of the arrow), and as shown in FIGS. 8A and 8B, the cleaning brush 62 is separated from the charging roll 16, thereby the cleaning operation is finished.

With such a method, the charging roll 16 is cleaned once in the axial direction by the cleaning operation of one time. However, the control section 80 may reversely turn the motor 78 in order to turn the shaft 70 in the reverse direction (in a clockwise direction) for operating the cleaning brush 62 from the state as shown in FIGS. 7A and 7B to the state as shown in FIGS. 6A and 6B so as to clean the charging roll 16 in reciprocating manner (in to-and-fro directions) along the axis (that is, the contact part between the cleaning brush 62 and the charging roll 16 is moved in to-and-fro directions).

In addition, the control section 80 may also control the directions of rotating of the shaft 70 by controlling of driving the motor 78 in order to repeat the operations of the cleaning brush 62 as shown in FIGS. 6A and 6B and as shown in FIGS. 7A and 7B plural times so that cleaning is performed more certainly before separating the cleaning brush 62 from the charging roll 16.

In addition, the control section 80 can control the direction of rotating of the shaft 70 in the constant direction by rotating the motor 78 in the constant direction such that the operation of the cleaning brush 62 as shown in FIGS. 6A and 6B, the operation of the cleaning brush 62 as shown in FIGS. 7A and 7B, the state of the cleaning brush 62 as shown in FIGS. 8A and 8B, the state of the cleaning brush 62 as shown in FIGS. 5A and 5B, and again the operation of the cleaning brush 62 as shown in FIGS. 6A and 6B are repeated in that order so that cleaning is performed more certainly.

In addition, because both end portions of the charging roll 16 are easier to become dirty than the central portion thereof, the control section 80 may control the drive of the motor 78 to lower the rotational speed of the shaft 70 substantially when the cleaning brush 62 contacting with the ends of the charging roll 16. Thereby, the moving speed of the contact part of the cleaning brush 62 can be lowered in the vicinity of the both ends of the charging roll 16.

Next, modifications of the first exemplary embodiment of the cleaning device of the present invention will be described. The same members as those in the first exemplary embodiment will be provided with the same signs and numerals, and the duplicated descriptions are omitted.

Figure 9A:
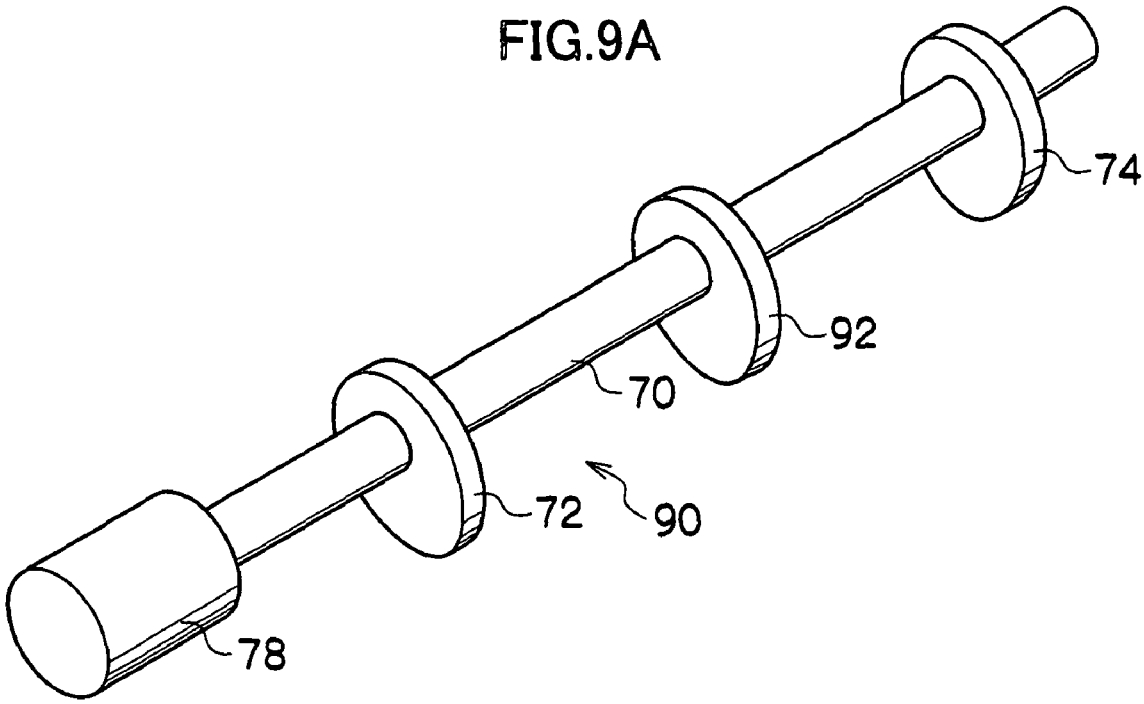
FIGS. 9A, 9B, and 9C are drawings illustrating a modification of the contact part moving device, FIG. 9A being a perspective view of the modified contact part moving device.
Figure 9B:
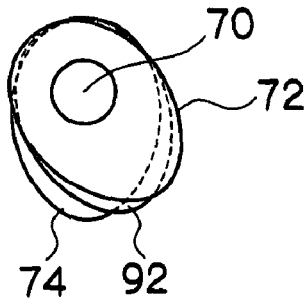
Figure 9C:
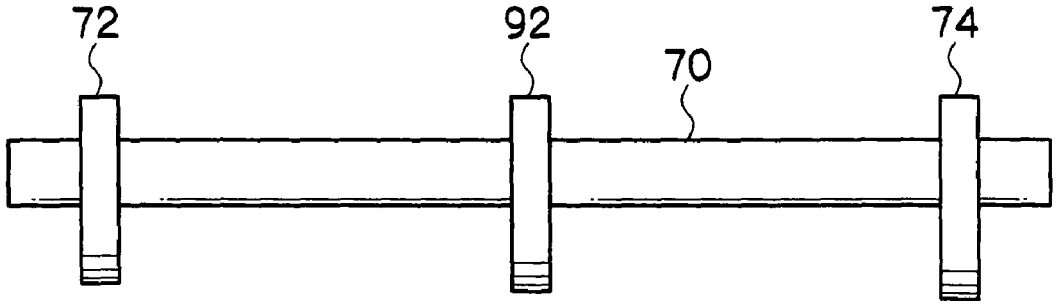
Figure 10A:
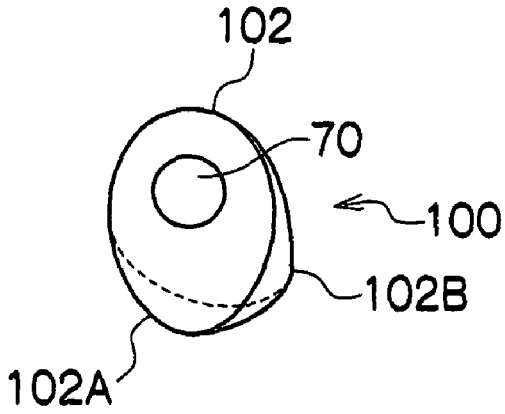
FIGS. 10A and 10B are drawings illustrating a modification of the contact part moving device, FIG. 10A being a side view of the modified contact part moving device, and FIG. 10B a front view of the modified contact part moving device.
Figure 10B:
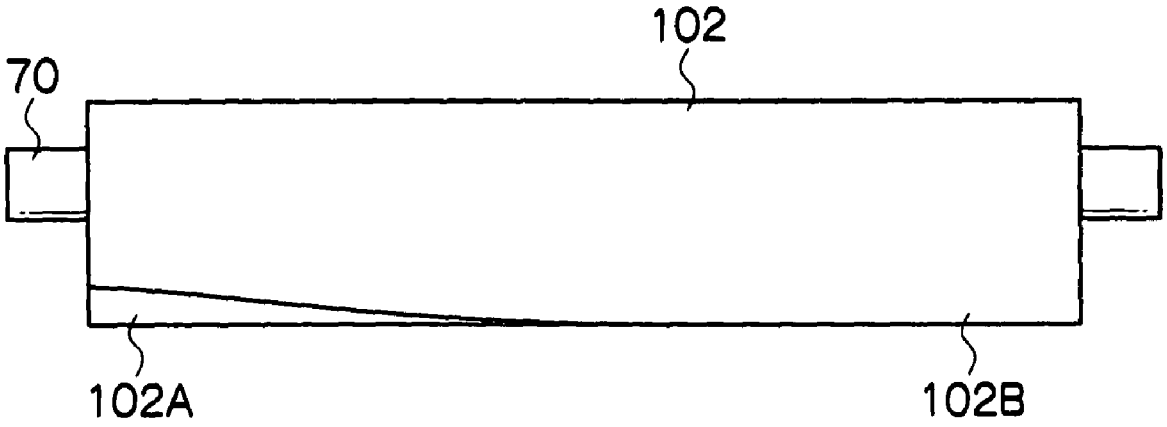

As shown in FIGS. 9A, 9B, and 9C, as the contact part moving device 90 which moves the contact part between the charging roll 16 (see FIG. 2) and the cleaning brush 62 (see FIG. 2) in the longitudinal direction, a cam member 92 can be additionally provided between the cam members 72, 74 of the shaft 70, in other words, in the central portion of the shaft 70. As shown in FIG. 9B, the cam member 92 is substantially in the shape of an ellipse, having the same profile as those of the cam members 72, 74, however, the phases of the cam members 72, 92, 74 are shifted in the order of these, and the cam members 72, 92, 74 are mounted on the shaft 70. That is, the phase of the cam member 92 is set between the phases of the cam members 72 and 74. Thereby, even though the cleaning brush 62 (see FIGS. 4A and 4B) has a lower rigidity such that the central portion in the longitudinal direction would be deflected, it is suppressed that the contact pressure between the cleaning brush 62 (see FIGS. 4A and 4B) and the charging roll 16 (see FIG. 2) in the central portion is weakened. The cam members 72, 74, 92 may be members having a circular cross section and a position of an axis of rotation (a shaft center) being shifted from a center thereof, that is, so-called, eccentric cams As shown in FIGS. 10A and 10B, as the contact part moving device 100 which moves the contact part between the charging roll 16 (see FIG. 2) and the cleaning brush 62 (see FIG. 2) in the longitudinal direction, the shaft 70 can be provided with a cam member 102 in the shape of a roll which has a cross section in the shape of an ellipse, and whose cross section is varied along the longitudinal direction. The cam member 102 is formed longer than the charging width (the maximum operating width) in the longitudinal direction of the charging roll 16, and is formed such that the cross section thereof is gradually varied between one end 102A and the other end 102B in the longitudinal direction. Because such a cam member 102 can support the cleaning brush 62 (see FIG. 2) over the axial direction, certainly contact state between the cleaning brush 62 (see FIG. 2) and the charging roll 16 (see FIG. 2) can be obtained. The cam member 102 may be a member having a circular cross section and a position of an axis of rotation (a shaft center) being changed along the longitudinal direction thereof, that is, so-called, a cylinder eccentric cam member.

Figure 11B:
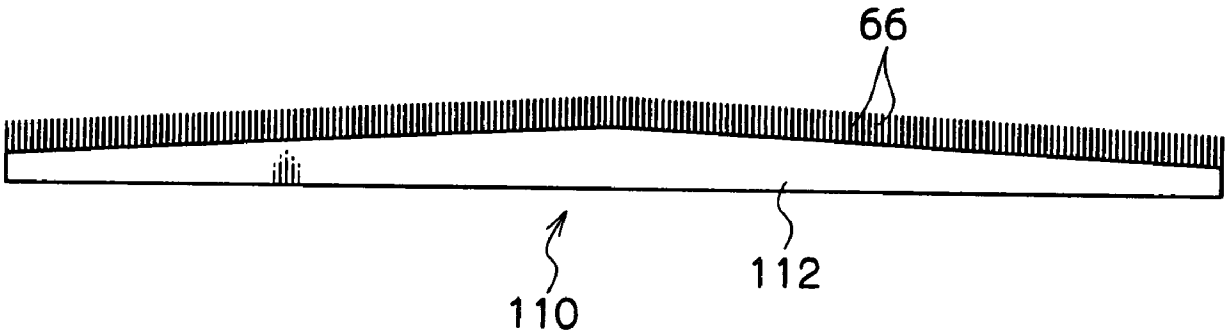
FIGS. 11A and 11B are drawings illustrating a modification of the cleaning brush, FIG. 11A being a side view of the modified cleaning brush, and FIG. 11B a front view the modified cleaning brush.
Figure 11A:
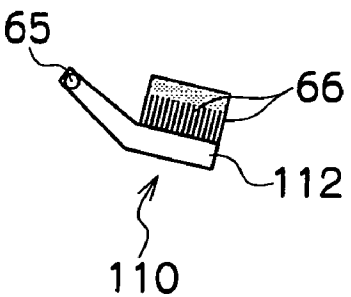

As shown in FIGS. 11A and 11B, in a cleaning brush 110, it is possible that the central portion of the support member 112 in the longitudinal direction is projected toward the side of the charging roll 16 (see FIG. 2) so as to have an angled geometry. On this portion of the angled geometry of the support member 112, plural brush bristles 66 are planted.

Figure 12B:
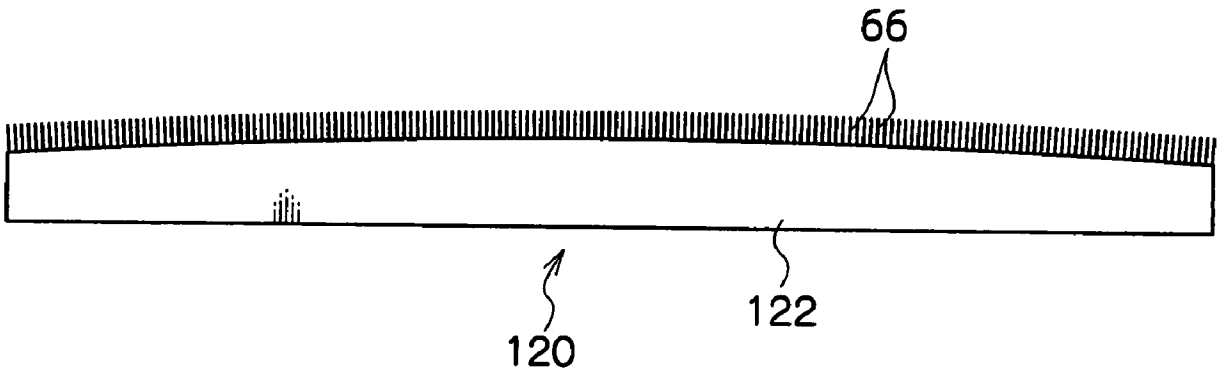
FIGS. 12A and 12B are drawings illustrating a modification of the cleaning brush, FIG. 12A being a side view of the modified cleaning brush, and FIG. 12B a front view the modified cleaning brush.
Figure 12A:
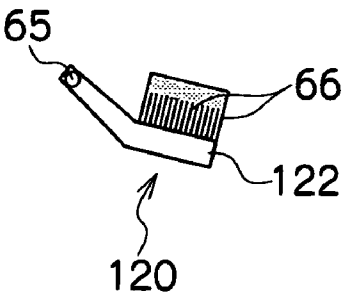

As shown in FIGS. 12A and 12B, in a cleaning brush 120, it is possible that the central portion of the support member 122 in the longitudinal direction is projected toward the side of the charging roll 16 (see FIG. 2) so as to have a circular-arc geometry. On this portion of the circular-arc geometry of the support member 122, plural brush bristles 66 are planted.

Figure 13:
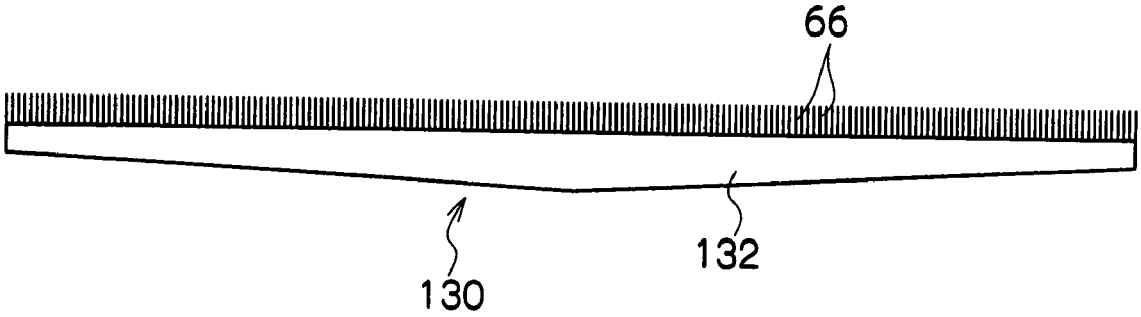
FIG. 13 is a front view illustrating a modification of the cleaning brush.

As shown in FIG. 13, in a cleaning brush 130, it is possible that the central portion of the support member 132 in the longitudinal direction is projected toward the side opposite to (the back side of) the charging roll 16 (see FIG. 2) so as to have an angled geometry. On the flat portion, which is at the side opposite to the angled geometry, of the support member 132, plural brush bristles 66 are planted.

Figure 14:
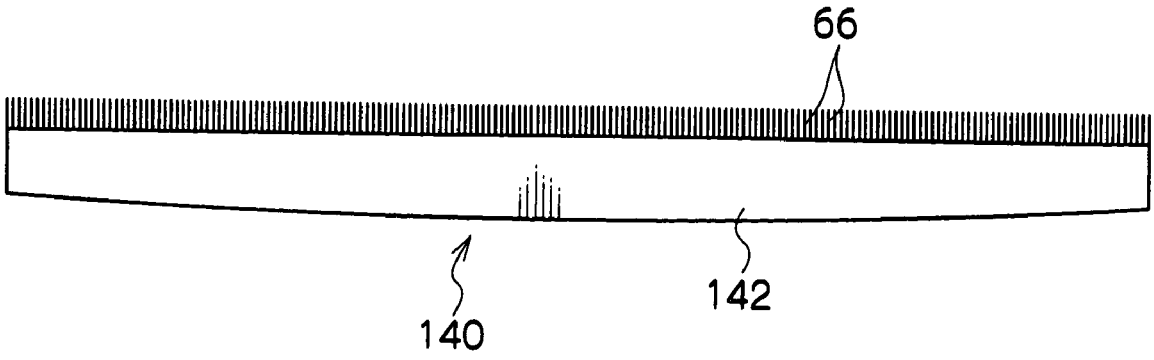
FIG. 14 is a front view illustrating a modification of the cleaning brush.

As shown in FIG. 14, in a cleaning brush 140, it is possible that the central portion of the support member 142 in the longitudinal direction is projected toward the side opposite to (the back side of) the charging roll 16 (see FIG. 2) so as to have a circular-arc geometry. On the flat portion, which is at the side opposite to the circular-arc geometry, of the support member 142, plural brush bristles 66 are planted.

Figure 15A:
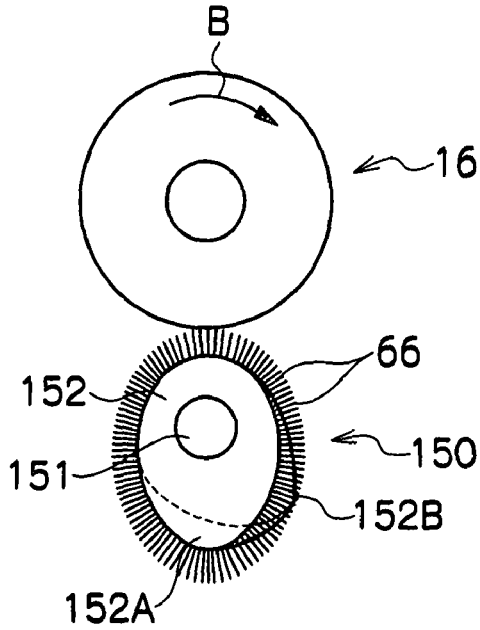
FIGS. 15A and 15B are drawings illustrating a modification of the cleaning brush, FIG. 15A being a side view of the modified cleaning brush, and FIG. 15B a front view the modified cleaning brush.
Figure 15B:
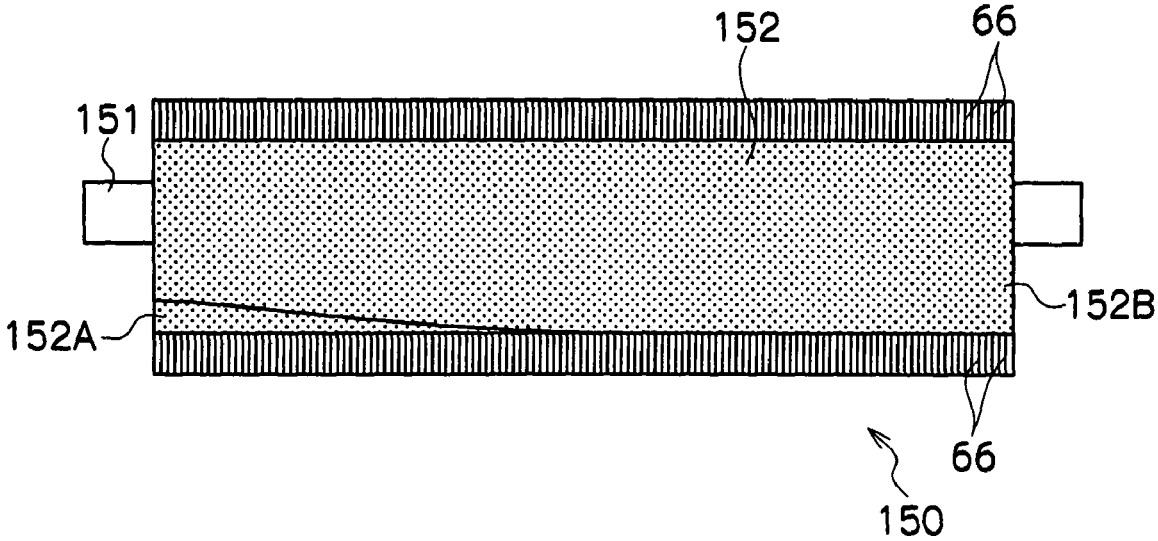

As shown in FIGS. 15A and 15B, a cleaning brush 150 is used. In the cleaning brush 150, an heteromorphy roll 152, which has a cross section in the shape of an ellipse and whose cross sectional shape is varied along the longitudinal direction, is provided around the shaft 151, and on the circumferential face of the heteromorphy roll 152, plural brush bristles 66 are planted. The heteromorphy roll 152 is formed longer than the charging width (the maximum operating width) in the longitudinal direction of the charging roll 16, and the cross section thereof is gradually varied between one end 152A and the other end 152B in the axial direction. By rotating this cleaning brush 150, the contact part between the cleaning brush 150 and the charging roll 16 (see FIG. 2) can be moved in the longitudinal direction, and the cleaning brush 150 can be separated from the charging roll 16 (see FIG. 2). Such a cleaning brush 150 can be used both as a contact part moving device and a cleaning brush. The heteromorphy roll 152 may be a roll having a circular cross section and a position of an axis of rotation (a shaft center) being changed along the longitudinal direction thereof.

Here, "cross section is varied" includes a case in which the cross sectional shapes is the same but is varied in orientation thereof, and a case in which the cross sectional shape itself is different along the longitudinal direction.

Next, an image formation apparatus which is another exemplary embodiment of the present invention will be described. The same members as those in the above-described exemplary embodiment will be provided with the same signs and numerals, and the duplicated descriptions are omitted.

Figure 16:
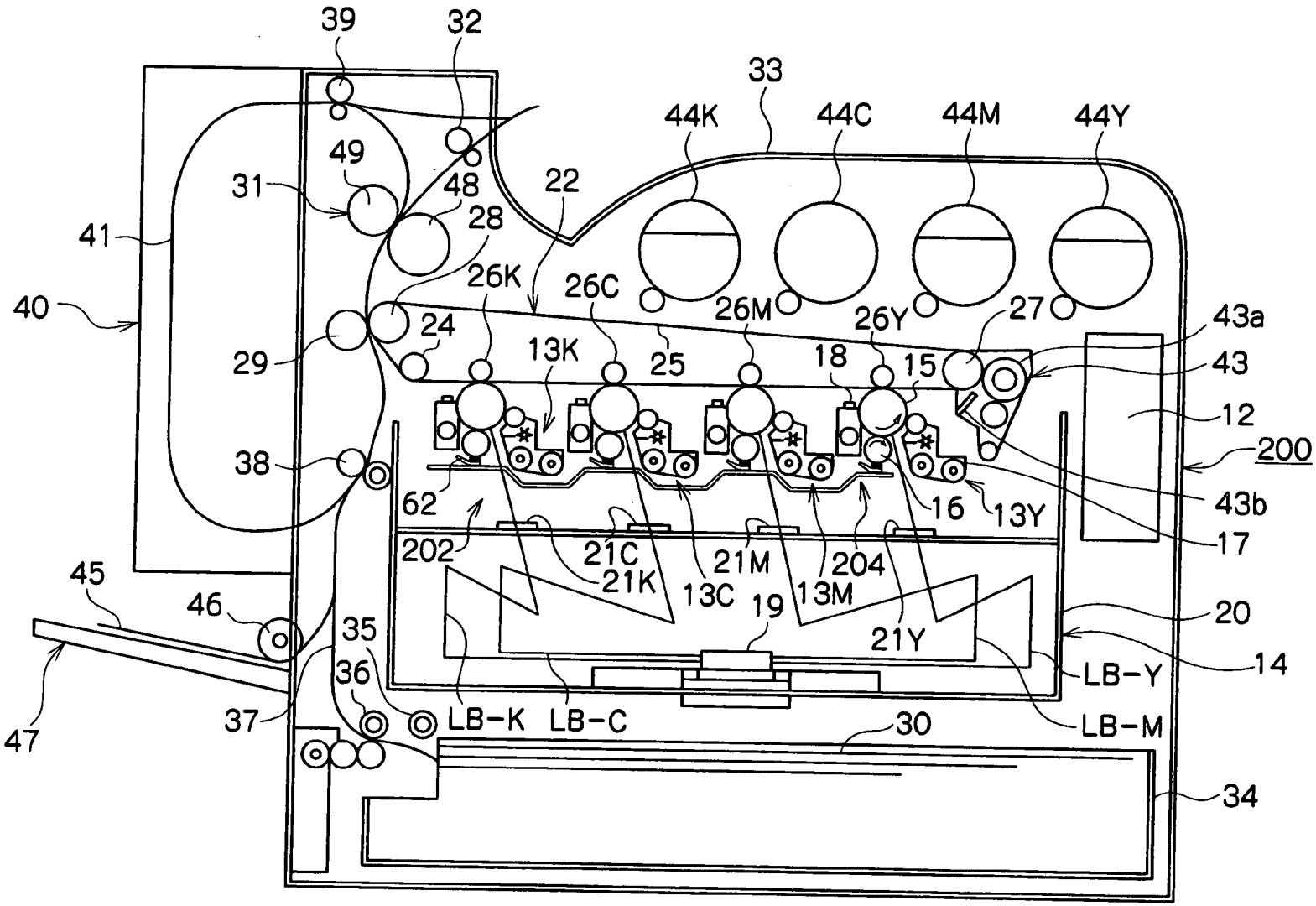
FIG. 16 is a schematic configuration drawing illustrating an image formation apparatus pertaining to another exemplary embodiment of the present invention.
Figure 17:
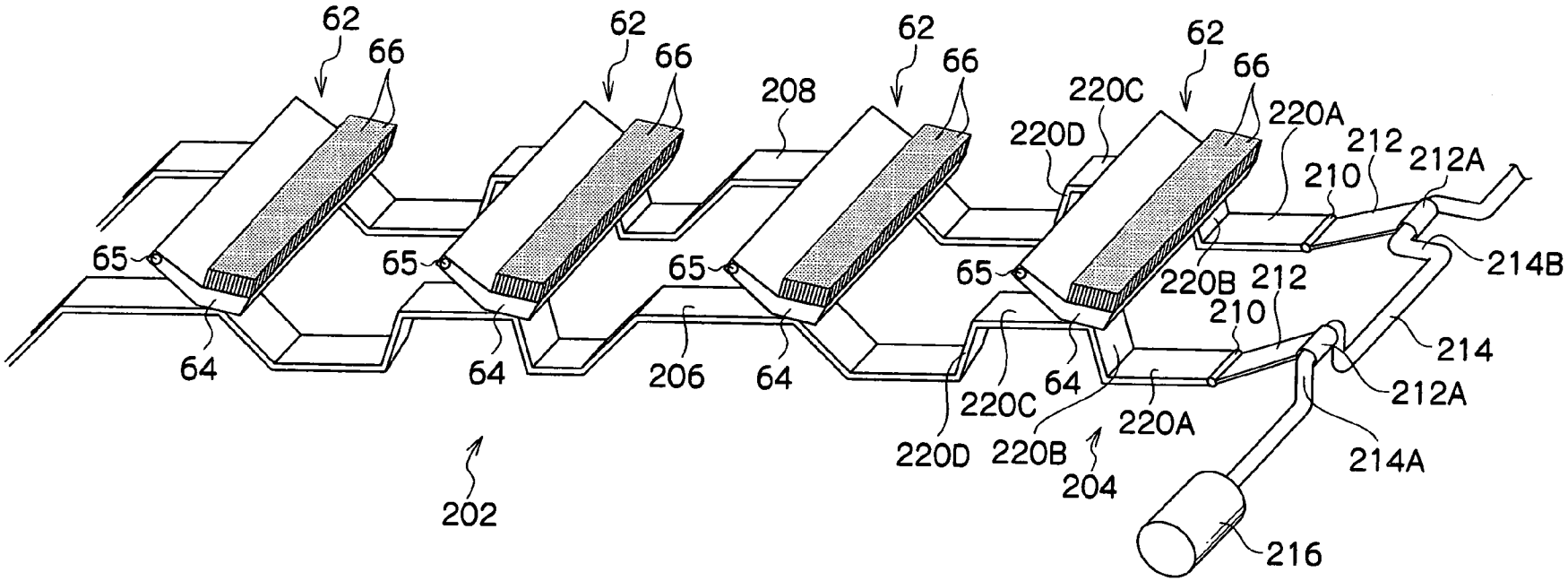
FIG. 17 is a perspective view illustrating plural cleaning brushes, contact part moving devices, and components in the vicinity thereof which are used in the image formation apparatus as shown in FIG. 16.

As shown in FIG. 16, in this image formation apparatus 200, at a lower portion of the charging roll 16 which is provided in each of the image formation units 13Y, 13M, 13C, and 13K, a cleaning device 202 which cleans the surface of the charging roll 16 is provided. As shown in FIG. 16 and FIG. 17, this cleaning device 202 includes four cleaning brushes 62 for cleaning the surfaces of the four charging rolls 16, respectively. Each of the cleaning brushes 62 is swingably supported by a pivotal shaft 65 provided in the support member 64.

In addition, in this cleaning device 202, a contact part moving device 204 which moves each contact part of the cleaning brush 62 with the charging roll 16 in the longitudinal direction is provided. This contact part moving device 204 includes two drive transmission members 206, 208 made of a sheet metal that, as shown in FIG. 17, are formed, being folded in a prescribed geometry, such that they bridge both end portions of the four cleaning brushes 62, respectively. To each one end of the drive transmission member 206, 208, one end of a plate-like part 212 is connected via a hinge part 210, and at the other end of the plate-like part 212, a cylindrical connection part 212A is formed. In addition, at an outer side of the image formation unit 13Y, a shaft 214 is disposed approximately in parallel with the cleaning brush 62, and in this shaft 214, a first crank part 214A which is projected substantially in the shape of a letter U in a prescribed direction, and a second crank part 214B which is projected substantially in the shape of a letter U in the direction perpendicular to that of the first crank part 214A are formed. Here, it is not limited that projecting direction of the second crank part 214B is perpendicular to that of the first crank part 214A, it is possible that an angle between the projecting directions of the second crank part 214B and the first crank part 214A is an angle other than 90 degree. The connection part 212A of the plate-like part 212 connected to the drive transmission member 206 is rotatably mounted to the first crank part 214A, and the connection part 212A of the plate-like part 212 connected to the drive transmission member 208 is rotatably mounted to the second crank part 214B. At one end of the shaft 214, a motor 216 is provided, and by driving the motor 216, the shaft 214 is rotated in a constant direction.

In addition, in each of the drive transmission member 206, 208, a horizontal lower plate part 220A which is connected to the hinge part 210; a short inclined plate part 220B which is provided, inclined slantwise upward from this lower plate part 220A; an upper plate part 220C which is horizontally provided at the end of this inclined plate part 220B; and a short inclined plate part 220D which is provided, inclined slantwise downward from this upper plate part 220C are formed as a section for one image formation unit, and three sections whose structure are similar to that of the section are formed for the other three image formation units, respectively, such that the four sections are connected to one another over the four image formation units. In other words, the upper plate part 220C is as a protruding part which is projected from the lower plate part 220A. The upper plate part 220C of each of the drive transmission member 206, 208 is butted against the support member 64 of the cleaning brush 62, respectively, to press the cleaning brush 62 against the charging roll 16.

Figure 18A:
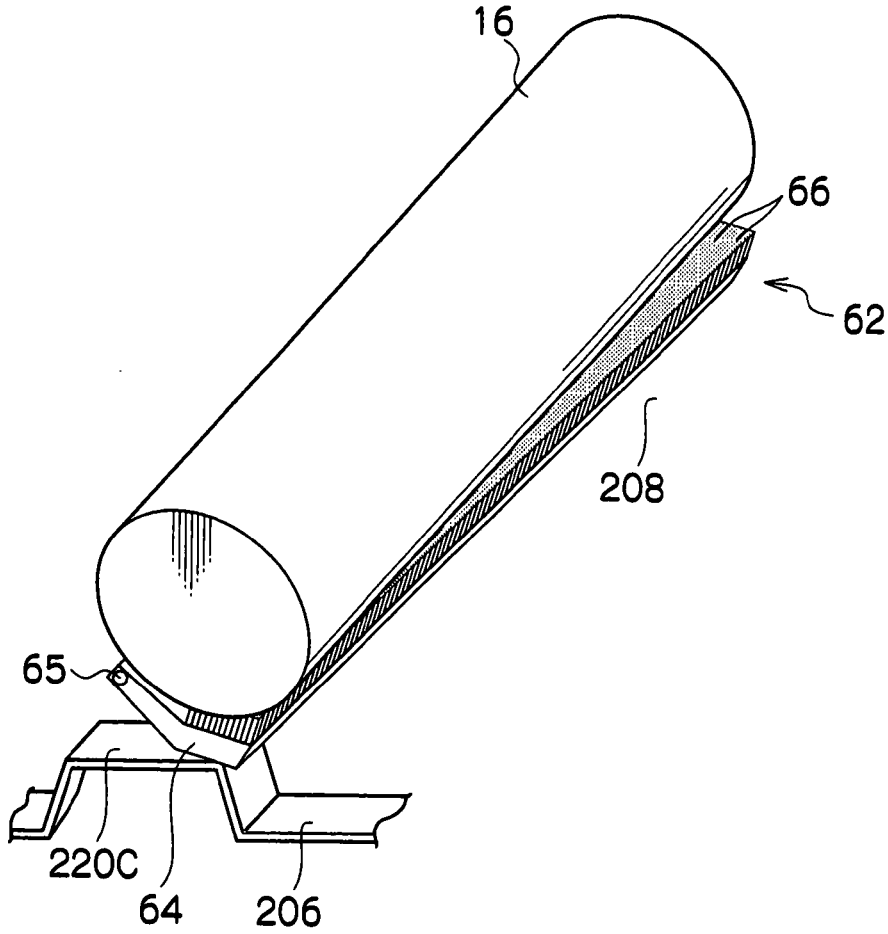
FIG. 18A is a perspective view illustrating the operation of moving the contact part between the cleaning brush and the charging roll in the longitudinal direction.
Figure 18B:
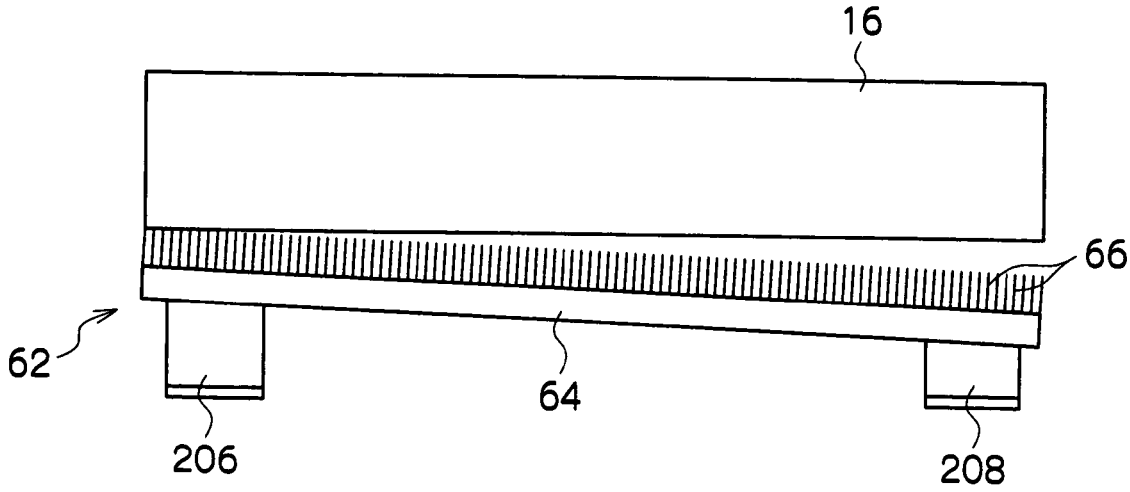
FIG. 18B is a front view of the cleaning brush and the charging roll.

The drive transmission members 206, 208 are disposed, bridging the image formation units 13Y, 13M, 13C, and 13K, and the drive transmission members 206, 208 are moved in the horizontal direction (in the direction orthogonal to the longitudinal direction of the charging roll 16) by the rotation of the shaft 214 with the drive transmission members 206, 208 being supported by a frame (not shown). At that time, because, in the first crank part 214A of the shaft 214, the connection part 212A of the drive transmission member 206 is provided, while in the second crank part 214B of the shaft 214, the connection part 212A of the drive transmission member 208 is provided, the drive transmission members 206, 208 can be moved in reciprocate manner with the respective phases being different from each other. In other words, as shown in FIG. 18A, the drive transmission members 206, 208 are moved in reciprocate manner while the positions of the upper plate parts 220C at this side and the other side of the cleaning brush 62 being different. The upper plate part 220C is butted against the back side of the support member 64, the cleaning brush 62 being pressed against the charging roll 16. Thus, as shown in FIGS. 18A and 18B, the timing of contact of the cleaning brush 62 with the charging roll 16 is shifted between this side and the other side. In addition, by the movement of the drive transmission members 206, 208, the contact part between the cleaning brush 62 and the charging roll 16 is moved in the longitudinal direction, and the cleaning brush 62 is separated from the charging roll 16.

In the above-described exemplary embodiments, the cleaning brush 62 for cleaning the charging roll 16 is used, however, the present invention is not limited to this configuration. For example, as the cleaning member, a cleaning pad including a sponge made up of a foamed resin may be used in place of the cleaning brush.

In the above-described exemplary embodiments, the cleaning device is one which cleans the charging roll 16, however, the cleaned object (an element to be cleaned) is not limited to the charging roll 16. For example, if the element to be cleaned is one which is rotatable, such as a transfer roll, the cleaning device of the present invention is applicable thereto.

The image formation apparatus 1, 200 in the above-mentioned exemplary embodiments is configured to arrange the image formation units for yellow, magenta, cyan, and black side by side along the moving direction of the intermediate transfer belt, however, the present invention is not limited to this configuration. For example, even if the image formation apparatus is one which, using a rotary developer unit, in which developer units of four colors are arranged repetitively, forms a toner image on the photosensitive drum four times (four cycles), the present invention is applicable thereto.

Hereinbelow, the configurations and the effects thereof in the above-described modifications of the exemplary embodiment pertaining to the present invention will be described.

1) In the cleaning brush 110, the central portion of the support member 112 in the longitudinal direction is projected toward the side of the charging roll 16 so as to have an angled geometry. On this portion of the angled geometry of the support member 112, plural brush bristles 66 are planted. Thus, at the time of cleaning in the vicinity of the central portion of the charging roll 16 (see FIG. 2), it can be suppressed that the length of the contact part between the cleaning brush 110 and the charging roll 16 (see FIG. 2) is increased resulting in an increase in load.

2) In the cleaning brush 120, the central portion of the support member 122 in the longitudinal direction is projected toward the side of the charging roll 16 (see FIG. 2) so as to have a circular-arc geometry. By using such the support member 122, the degree of opening of the brush bristles 66 is rendered uniform over the longitudinal direction, therefore which eliminates the possibility that the brush bristles may be opened in the summit portion (the central portion in the longitudinal direction) resulting in the cleaning capacity being nonuniform, as would be happened when the support member having an angled geometry is used.

What is claimed is:

1. A cleaning device comprising:

a cleaning member that cleans a surface of a rotating cylindrical element to be cleaned, and whose length in a longitudinal direction is longer than a length of the maximum operating region of the element to be cleaned;

a length of a contact part of the cleaning member at which the cleaning member contacts with the element to be cleaned being shorter than the length in the longitudinal direction of the cleaning member, the contact part being moved in the longitudinal direction of the element to be cleaned, and a contact part moving member that moves the contact part in the longitudinal direction by changing an attitude of the cleaning member such that the longitudinal direction of the cleaning member is changed, wherein the contact part moving member moves the cleaning member such that the longitudinal direction of a support of the cleaning member is inclined with respect to longitudinal direction of the element to be cleaned.

2. The cleaning device of claim 1, wherein the contact part moving member separates the cleaning member from the element to be cleaned by changing the attitude of the cleaning member.

3. The cleaning device of claim 1, wherein a cross section of the cleaning member with respect to the longitudinal direction is set such that the cross section in the vicinity of a central portion in the longitudinal direction is larger than the cross sections at both end portions in the longitudinal direction.

4. The cleaning device of claim 1, further comprising a contact part control section that changes at least one of a moving speed and a moving direction of the contact part.

5. The cleaning device of claim 4, wherein the contact part control section makes the moving speed of the contact part slower at an end portion in the longitudinal direction of the element to be cleaned than at a central portion in the longitudinal direction of the element to be cleaned.

6. The cleaning device of claim 4, wherein the contact part control section reciprocates the contact part in a predetermined range of the element to be cleaned.

7. The cleaning device of claim 1, wherein the element to be cleaned is a charging roll that contacts and charges a surface of an image holding element on which a toner image is to be formed.

8. The cleaning device of claim 1, wherein the contact part moving member moves the contact part by changing the attitude of the cleaning member by changing a pressing amount against the cleaning member in the direction toward the element to be cleaned at least two positions in the longitudinal direction of the cleaning member.

9. The cleaning device of claim 1, wherein the contact part moving member comprises:

a shaft that is arranged substantially parallel to the longitudinal direction of the cleaning member;

a rotating section that rotates the shaft;

a first cam member that is provided at the shaft and changes a pressing amount against the cleaning member in the direction toward the element to be cleaned due to rotation of the shaft; and a second cam member that is provided at the shaft at a position apart from the first cam member and changes a pressing amount against the cleaning member in the direction toward the element to be cleaned due to rotation of the shaft, the first cam member and the second cam member are provided at the shaft such that phases of the first cam member and the second cam member are different.

10. The cleaning device of claim 9, wherein the contact part moving member further comprises a third cam member that is provided at the shaft at a position apart from the first cam member and the second cam member and changes a pressing amount against the cleaning member due to rotation of the shaft, the third cam member being provided at the shaft such that a phase of the third cam member is different from those of the first cam member and the second cam member.

11. The cleaning device of claim 9, wherein the first cam member and the second cam member are provided at the shaft in the vicinity of positions corresponding to both end portions of the cleaning member in the longitudinal direction.

12. The cleaning device of claim 8, wherein the contact part moving member is a roll that is arranged substantially parallel to the longitudinal direction of the cleaning member, and whose cross section is varied along the longitudinal direction.

13. The cleaning device of claim 1, wherein the contact part moving member comprises:

a first drive transmission member that is provided in the vicinity of one end portion of the cleaning member in the longitudinal direction and changes a pressing amount against the cleaning member in the direction toward the element to be cleaned;

a second drive transmission member that is provided in the vicinity of the other end portion of the cleaning member in the longitudinal direction and changes a pressing amount against the cleaning member in the direction toward the element to be cleaned; and a driving section that drives the first drive transmission member and the second drive transmission member such that movements of the first drive transmission member and the second drive transmission member are different.

14. A process cartridge comprising:

a rotating cylindrical element to be cleaned that contacts and charges a surface of an image holding element on which a toner image is to be formed; and a cleaning device that comprises a cleaning member that cleans a surface of the element to be cleaned, and whose length in a longitudinal direction is longer than a length of the maximum operating region of the element to be cleaned, a length of a contact part of the cleaning member at which the cleaning member contacts with the element to be cleaned being shorter than the length in the longitudinal direction of the cleaning member, and the contact part being moved in the longitudinal direction of the element to be cleaned, wherein a contact part moving member moves the cleaning member such that the longitudinal direction of a support of the cleaning member is inclined with respect to longitudinal direction of the element to be cleaned.

15. An image formation apparatus comprising: an image holding element that is rotationally driven;

a rotating cylindrical element to be cleaned that is rotated by being driven due to rotation of the image holding element, and contact-charges a surface of the image holding element; and a cleaning device comprising a cleaning member that cleans a surface of the element to be cleaned, and whose length in a longitudinal direction is longer than a length of the maximum operating region of the element to be cleaned, a length of a contact part of the cleaning member at which the cleaning member contacts with the element to be cleaned being shorter than the length in the longitudinal direction of the cleaning member, and the contact part being moved in the longitudinal direction of the element to be cleaned, wherein a contact part moving member moves the cleaning member such that the longitudinal direction of a support of the cleaning member is inclined with respect to longitudinal direction of the element to be cleaned.

* * * * *